US007930185B2

(12) United States Patent
Tsuchinaga et al.

(10) Patent No.: US 7,930,185 B2
(45) Date of Patent: Apr. 19, 2011

(54) APPARATUS AND METHOD FOR CONTROLLING AUDIO-FRAME DIVISION

(75) Inventors: Yoshiteru Tsuchinaga, Fukuoka (JP); Masanao Suzuki, Kawasaki (JP); Miyuki Shirakawa, Fukuoka (JP); Takashi Makiuchi, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 375 days.

(21) Appl. No.: 12/073,276

(22) Filed: Mar. 3, 2008

(65) Prior Publication Data

US 2008/0154589 A1 Jun. 26, 2008

Related U.S. Application Data

(63) Continuation of application No. PCT/JP2005/016271, filed on Sep. 5, 2005.

(51) Int. Cl.
*G10L 19/00* (2006.01)
*G10L 19/02* (2006.01)

(52) U.S. Cl. ..... 704/500; 704/200.1; 704/229; 704/230

(58) Field of Classification Search ..... None
See application file for complete search history.

(56) References Cited

U.S. PATENT DOCUMENTS

| | | | | |
|---|---|---|---|---|
| 5,627,938 | A | 5/1997 | Johnston | |
| 6,499,010 | B1 * | 12/2002 | Faller | 704/229 |
| 7,613,603 | B2 * | 11/2009 | Yamashita | 704/200.1 |
| 7,627,481 | B1 * | 12/2009 | Kuo et al. | 704/500 |
| 2004/0196913 | A1 * | 10/2004 | Chakravarthy et al. | 375/254 |

FOREIGN PATENT DOCUMENTS

| | | |
|---|---|---|
| EP | 0 559 348 | 9/1993 |
| EP | 1 517 300 | 3/2005 |
| JP | 5-506345 | 9/1993 |
| JP | 6-259098 | 9/1994 |
| JP | 11-027240 | 1/1999 |
| WO | WO 91/16769 | 10/1991 |

OTHER PUBLICATIONS

J. Herre, "Temporal noise shaping, quantization and coding methods in perceptual audio coding: a tutorial introduction," in AES 17th International Conference, pp. 312-325, 1999.*

T. Painter and A. Spanias. Perceptual coding of digital audio. Proc. IEEE, 88(4), Apr. 2000.*

JP 2005-003835 Machine Translation.*

International Search Report (PCT/ISA/210) mailed Dec. 6, 2005 for International Application No. PCT/JP2005/016271, (2 pages).

(Continued)

*Primary Examiner* — Matthew J Sked
(74) *Attorney, Agent, or Firm* — Fujitsu Patent Center

(57) ABSTRACT

To alleviate degradation of sound quality which may be caused by pre-echoes and bit starvation. An acoustic analyzer analyzes an audio signal to calculate perceptual entropy indicating how many bits are required for quantization. A coded bit count monitor monitors the number of coded bits produced from the audio signal and calculates the number of available bits for the current frame. Based on the combination of the perceptual entropy and the number of available bits, a frame division number determiner determines a division number N for dividing a frame of the audio signal into N blocks. An orthogonal transform processor divides a frame by the determined division number and subjects each divided block of the audio signal to an orthogonal transform process, thereby obtaining orthogonal transform coefficients. A quantizer quantizes the orthogonal transform coefficients on a divided block basis.

8 Claims, 13 Drawing Sheets

OTHER PUBLICATIONS

Patent Abstracts of Japan; Japanese Publication No. 2004-054156, published Feb. 19, 2004, (1 pg).
Patent Abstracts of Japan; Japanese Publication No. 2004-252068, published Sep. 9, 2004, (1 pg).
Patent Abstracts of Japan; Japanese Publication No. 2005-062296, published Mar. 10, 2005, (1 pg).
Patent Abstracts of Japan; Japanese Publication No. 2002-014696, published Jan. 18, 2002, (1 pg).
Patent Abstracts of Japan; Japanese Publication No. 2005-003835, published Jan. 6, 2005, (1 pg).
Patent Abstracts of Japan; Japanese Publication No. 03-060529, published Mar. 15, 1991, (1 pg).
Patent Abstracts of Japan; Japanese Publication No. 2003-345398, published Dec. 3, 2003, (1 pg).
Patent Abstracts of Japan; Japanese Publication No. 2005-165056, published Jun. 23, 2005, (1 pg).
Patent Abstracts of Japan; Japanese Publication No. 09-232964, published Sep. 5, 1997, (1 pg).
Patent Abstracts of Japan; Japanese Publication No. 62-139089, published Jun. 22, 1987, (1 pg).
Patent Abstracts of Japan; Japanese Publication No. 06-051795, published Feb. 25, 1994, (1 pg).
Japanese Patent Office Action in Application No. 2007-534206, issued Oct. 27, 2009.
Patent Abstracts of Japan, Publication No. 6-259098, published Sep. 16, 1994.
Patent Abstracts of Japan, Publication No. 11-027240, published Jan. 29, 1999.
Litao Gang, et al. "MP3 Resistant Oblivious Steganography" New Jersey Center for Multimedia Research, ECE Dept., New Jersery Institute of Technology, vol. 3, 2001 IEEE, May 7, 2001, pp. 1365-1368.
Ram Rangachar, et al. "A Simulation Tool for Introducing MPEG-Audio (MP3) Concepts in a DSP Course", Department of Electrical Engineering, MIDL, Telecommunications Research Center, Tempe, Arizona, vol. 4, 2002 IEEE May 13, 2002 (pp. 4116 to 4119).
Extended European Search Report issued Jul. 24, 2009 in European Application No. 05 77 6793, related to the above-identified present pending US patent application (7 pages).

* cited by examiner

FIG. 8 *Related Art*
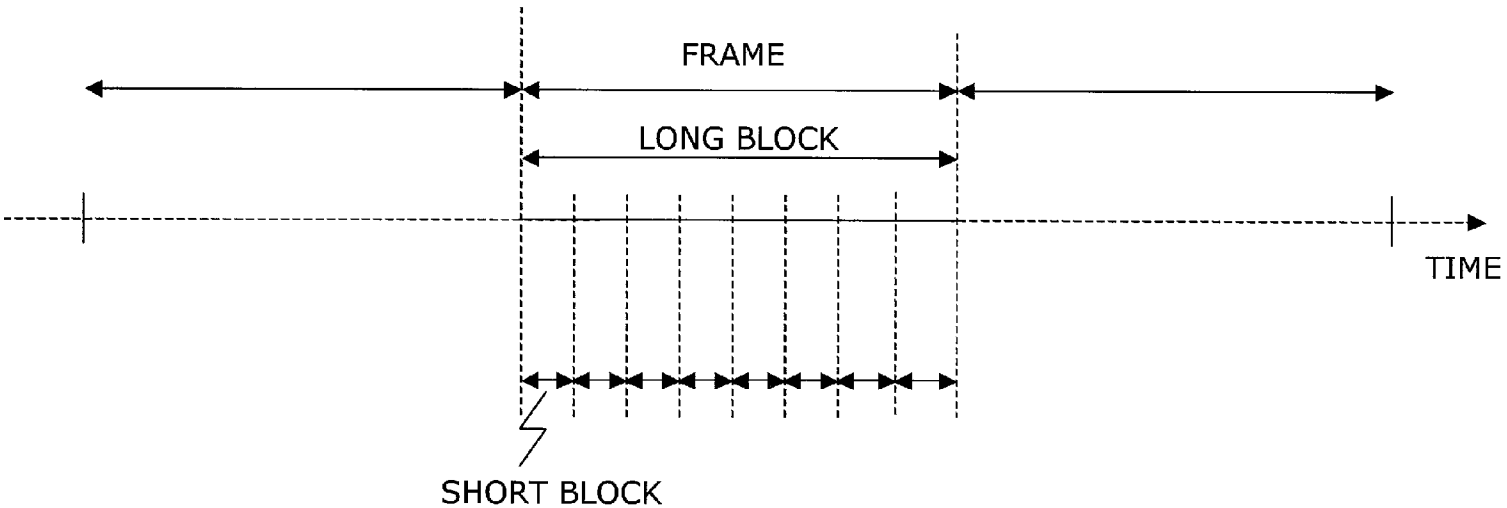

FIG. 9 *Related Art*
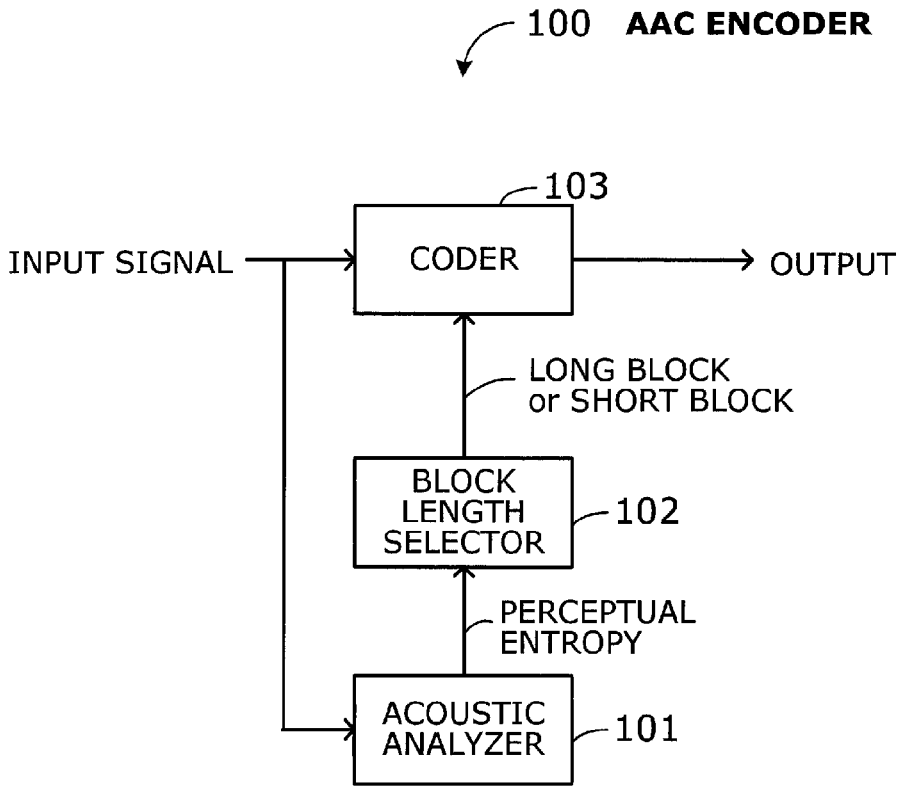

FIG. 10 *Related Art*
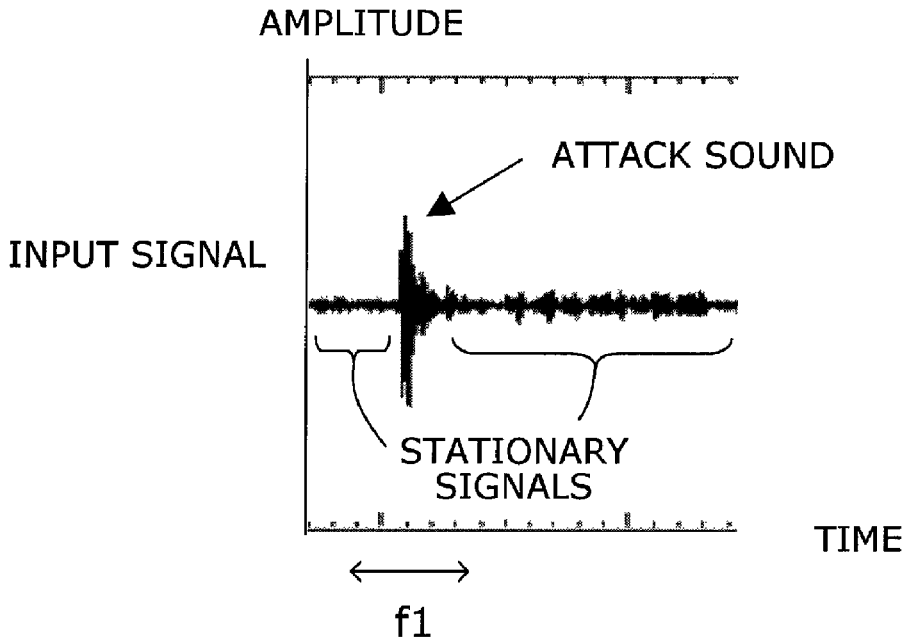

FIG. 11 *Related Art*
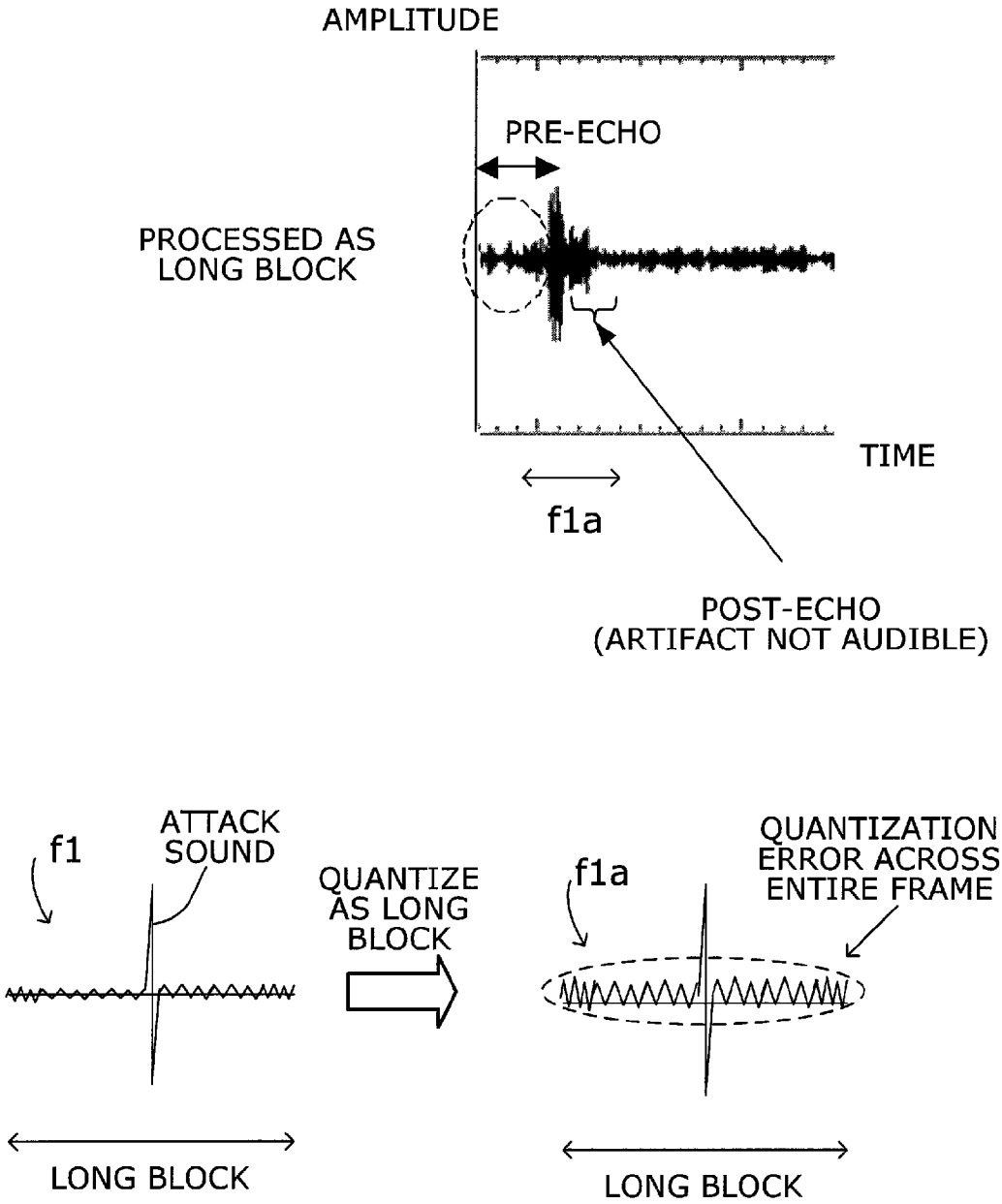

FIG. 12 *Related Art*
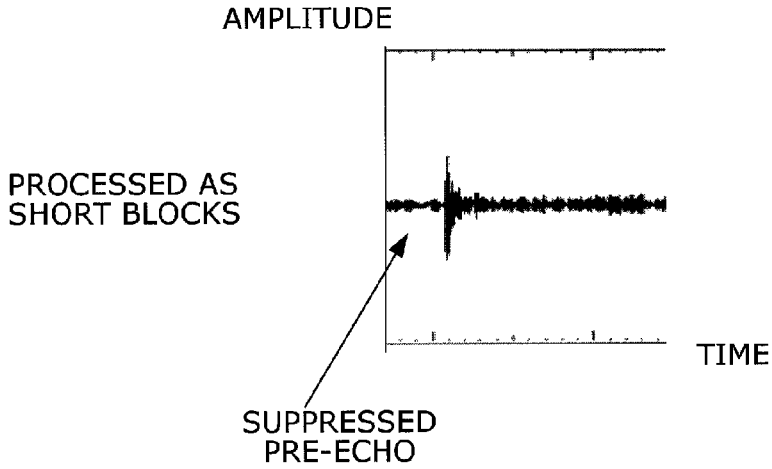
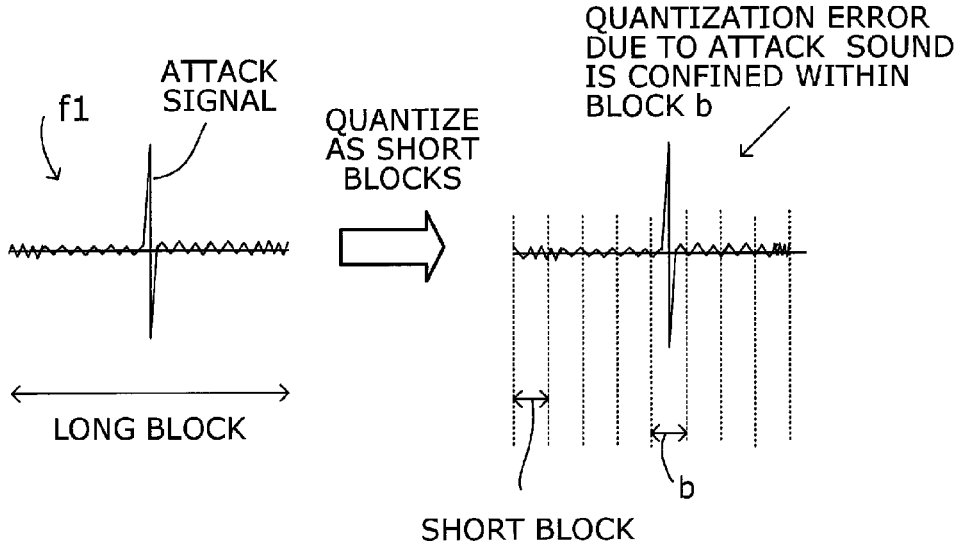

FIG. 13 *Related Art*
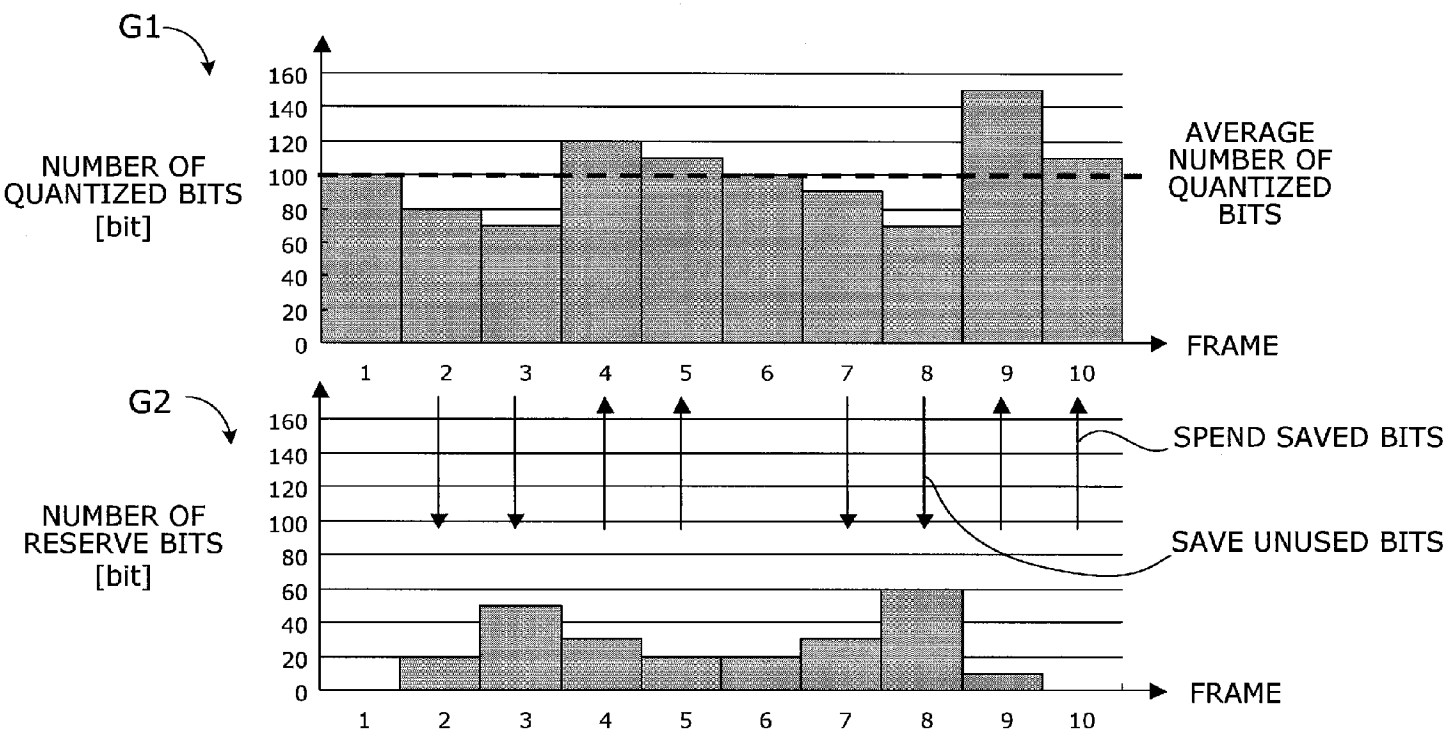

APPARATUS AND METHOD FOR CONTROLLING AUDIO-FRAME DIVISION

This application is a continuing application, filed under 35 U.S.C. §111(a), of International Application PCT/JP2005/016271, filed Sep. 5, 2005.

BACKGROUND OF THE INVENTION (1) Field of the Invention

The present invention relates to an apparatus and method for encoding audio signals. More particularly, the present invention relates to an apparatus and method for encoding audio signals for use in the fields of data communications such as mobile phone networks and the Internet, digital televisions and other broadcasting services, and audio/video recording and storage devices using MD, DVD, and other media.

(2) Description of the Related Art

Recent years have seen a growing need for audio coding techniques enabling efficient compression of audio signals, as a result of rapid proliferation of Internet communications and digital terrestrial broadcasting services, as well as widespread use of DVD, digital audio players, and other audio/video appliances.

Adaptive transform coding is used as a mainstream method for audio coding. This technique exploits the characteristics of the human hearing system to compress data by reducing redundancy of acoustic information and suppressing imperceptible sound components.

The basic process flow of adaptive transform coding includes the following steps:

- transforming an audio signal from time domain to frequency domain
- partitioning the frequency-domain signals into multiple frequency bands according to the frequency resolution of human hearing
- calculating an optimal data bandwidth for encoding signal components in each frequency band, based on the human hearing characteristics
- quantizing the frequency-domain signals according to the data bandwidth assigned to each frequency band Among the available techniques of adaptive transform coding, MPEG2 AAC is particularly of interest in recent years, where MPEG2 stands for "Moving Pictures Experts Group-2" and AAC "Advanced Audio Coding." MPEG AAC is used, for example, in terrestrial digital broadcasting systems. The International Standardization Organization/International Electro technical Commission (ISO/IEC) has standardized the MPEG2 AAC technology (hereafter simply "AAC") as ISO/IEC 13818-7, Part 7, titled "Advanced Audio Coding" (AAC).

The AAC encoder samples a given analog audio signal in the time domain and partitions the resulting series of digital values into frames each consisting of a predetermined number of samples.

One frame may be processed as a single LONG block with a length of 1024 samples or as a series of SHORT blocks with a length of 128 samples. The selection of which block length to use is made in an adaptive manner, depending on the nature of audio signals. Audio signals are encoded on an individual block basis.

FIG. 8 shows the relationship between LONG blocks and SHORT blocks. One frame contains 1024 samples. A LONG block is the entire span of such a frame. A SHORT block is one eighth of the frame, thus containing 128 samples.

Accordingly, the encoder processes audio signals in units of frames in the case where LONG block is selected, and in units of eighth frames in the case where SHORT block is selected.

FIG. 9 shows an overview of a conventional AAC encoder. This AAC encoder 100 is formed from an acoustic analyzer 101, a block length selector 102, and a coder 103.

The acoustic analyzer 101 subjects an input signal to a Fast Fourier Transform (FFT) analysis to obtain an FFT spectrum. Then the acoustic analyzer 101 calculates perceptual entropy from the FFT spectrum and passes it to the block length selector 102. Perceptual entropy is a parameter indicating the number of bits required for quantization.

The block length selector 102 selects SHORT block if the received perceptual entropy exceeds a predetermined threshold (constant), and it selects LONG block if the perceptual entropy does not exceed the threshold.

In the case where the block length selector 102 has selected LONG block for coding a frame of the input signal, the coder 103 encodes that frame on a LONG block basis. In the case where SHORT block is selected, the coder 103 encodes the frame on a SHORT block basis.

The coding process applies an orthogonal transform to each single frame on a LONG block basis or a SHORT block basis. The resulting orthogonal transform coefficients are then quantized for each frequency band, within a limit of an allocated number of bits, thus producing an output bitstream for transmission.

In the case where the input frame is a stationary signal having little variations in its amplitude and frequency as in the case of sine waves, it is advantageous to encode the frame as a LONG block (i.e., encode the entire frame as a single unit of data) since such a signal with little variations does not require a large data bandwidth. That is, a series of signal sections can be encoded efficiently by processing them as a single section if their amplitude and frequency do not vary much.

Since the number of quantized bits will not be large in stationary sections, a frame carrying such stationary signals has a small perceptual entropy (parameter indicating the number of bits required for quantization) falling below the threshold. The coding process thus decides to encode the frame as a LONG block.

In contrast to the above, there may be a frame carrying a signal with a steep change in its amplitude or frequency. If a frame containing such a signal (referred to hereafter as an "attack sound") is encoded as a LONG block, the resulting coded sound signal would have an artifact called "pre-echo" and consequent quality degradation.

The following section will discuss the problem of pre-echoes with reference to FIGS. 10 to 12, where the horizontal axis represents time and the vertical axis represents amplitude. FIG. 10 shows a source input signal containing an attack sound. Specifically, this input signal frame f1 contains both an attack sound and stationary signal components.

FIG. 11 illustrates a pre-echo appearing in a decoded sound (frame f1*a*) in the case where the frame f1 is encoded as a single LONG block. The frame f1 contains both an attack sound and a stationary signal, the components being quite distinct from each other. This frame f1 is encoded as a LONG block and quantized in the frequency domain. As FIG. 11 shows, the resulting signal has a significant quantization noise (appearing as fine distortions) across the entire frame f1, which is derived from the attack sound.

The quantization error appearing before the attack sound can be heard by the user as a grating noise called a pre-echo, which causes degradation of sound quality. The attack sound section is also affected by the quantization error. This is, however, masked by the attack sound itself, hardly causing noticeable problems.

The quantization error further appears as a noise signal after the attack sound section, which is called "post-echo." The human hearing system, however, does not perceive such short-period noise after a loud sound. For this reason, post-echoes are not perceived as a problem in most cases.

It is pre-echoes that is audible to human ears and eventually deteriorates the sound quality. The audio coding process thus places importance on how to suppress pre-echoes.

FIG. 12 shows a decoded sound whose source signal has been encoded as SHORT blocks. Pre-echoes are suppressed since the frame f1 has been encoded as SHORT blocks. While block b contains an attack sound, the resulting quantization error is confined within that block b, without affecting any other blocks. This is why the SHORT-block encoding can suppress pre-echoes.

The coding process thus decides to encode a frame as SHORT blocks when it contains a steeply changing signal such as an attack sound, thereby suppressing pre-echoes. Specifically, the attack-containing frame exhibits a large perceptual entropy exceeding a threshold since the attack sound produces a larger number of quantized bits when it is encoded. This large perceptual entropy causes the coding process to choose SHORT-block encoding.

As an example of an existing technique, Japanese Patent Application Publication No. 2005-3835 (paragraph Nos. 0028 to 0045, FIG. 1) proposes an audio coding technique to produce a bitstream with suppressed pre-echoes.

Most audio coding devices including AAC encoders have a bit reservoir function to implement pseudo-variable bitrate control to absorb fluctuations in the number of quantized bits.

FIG. 13 shows the concept of how a bit reservoir works. Graph G1 in this figure shows how many bits are used to quantize frames, where the horizontal axis represents a sequence of frames and the vertical axis represents the number of quantized bits consumed by each frame. Graph G2, on the other hand, shows how many bits remain unused in the bit reservoir when each frame is quantized, where the horizontal axis represents a sequence of frames and the vertical axis represents the number of reserve bits.

It is assumed here that the average number of quantized bits is set to 100 bits. The average number of quantized bits is a parameter used to determine the number of available bits, and it is calculated in accordance with transmission bitrates.

The number of bits required to represent a quantized frame may fall below or exceed the average number of quantized bits. In the former case, their difference is accumulated as available bits. In the latter case, the exceeding bits are supplied from the pool of available bits.

As can be seen from the figure, frame #1 is encoded into 100 quantized bits, which is equal to the average number of quantized bits. This means that there will be no more available bits. Frame #2 is, on the other hand, encoded into 80 quantized bits, which is 20 bits smaller than the average number of quantized bits. Accordingly, the available bits amount to 20 (=100−80).

Frame #3 is now encoded into 70 quantized bits. The number of available bits is now 50 (=100−70+20), including those not spent by frame #2.

Frame #4 is then encoded into 120 quantized bits, exceeding the average number of quantized bits by 20. In such a case, the excessive 20 bits are withdrawn from the pool of 50 available bits at the time of frame #3. The number of available bits thus decreases to 30 (=50−20). The subsequent frames are assigned an appropriate number of bits in the same way to absorb the fluctuations, thus achieving a variable bitrate control.

Suppose now that frames #2 and #3 are encoded as LONG blocks while frame #4 is encoded as SHORT blocks. LONG-block coding tends to leave more available bits since they require a smaller number of bits when they are quantized.

SHORT-block coding, on the other hand, requires a larger number of bits for quantization, thus consuming the available bits that have accumulated during the time of LONG-block coding.

Some circumstances may accept low compression ratios and allow the use of many bits for quantization. In such high-bitrate conditions, the encoder can select SHORT block for a frame containing an attack sound or a large variation exhibiting a high perceptual entropy. The SHORT-block coding suppresses pre-echoes, as well as permitting the bit reservoir to raise the average number of quantized bits. This means that the encoder is free from bit starvation in such conditions.

Other circumstances do not allow the use of many bits for quantization and thus requires high compression ratios. In such low-bitrate conditions, the bit reservoir has to operate with a smaller average number of quantized bits (i.e., it is not allowed to use many bits). Selecting SHORT-block coding because of a large perceptual entropy would use up available bits, soon falling into bit starvation. This results in a significant degradation of sound quality.

Quality degradation due to bit starvation is perceived to be more annoying than that of pre-echoes. That is, the sound degradation becomes worse in this situation despite the fact that SHORT blocks are selected to suppress pre-echoes in a frame containing a large variation like an attack sound.

Meanwhile, recent years have seen the emergence of a new broadcasting service whose bitrate is as low as 96 kbps to deliver stereo signals with a sampling rate of 48 kHz (at a compression ratio of 1/16 or a higher compression ratio). One example is the terrestrial digital broadcasting for mobile phones, which is known as "one segment broadcasting" service.

Without compression, transmission of 48-kHz sampled stereo signals requires a bandwidth of 1,536 kbps (48,000×16×2) since 48,000 samples of two 16-bit channels have to be transmitted per second. One sixteenth of 1,536 kbps is 96 kbps. Generally the CD-quality audio signals sampled at 44.1 kHz are compressed to about 128 kbps for use with player equipment using the MPEG Audio Layer 3 (MP3) format. The aforementioned terrestrial digital broadcasting for mobile phones requires even lower bitrates, e.g., 96 kbps. The compression ratios required in those applications are so high that the encoder faces difficulties in preventing sound quality degradation.

Audio signals may include a large transient component (e.g., attack sound) or a continuously varying component. If this is the case, broadcasting and communications services operating in a low-bitrate condition could encounter a sudden exhaustion of usable bits as a result of increased consumption of available bits in a bit reservoir.

Bit starvation during the process of encoding bit-consuming SHORT blocks will greatly reduce the performance of the encoder, thus spoiling the sound quality more than pre-echoes would do.

For this reason, the conventional AAC encoders used in digital terrestrial broadcasting or other low-bitrate services produce significant degradation of sound quality in spite of the fact that they select SHORT blocks correctly according to the nature of input signals.

Referring back to the foregoing conventional technique (Japanese Patent Application Publication No. 2005-3835), the encoder determines a perceptual entropy threshold according to the number of available bits under control of a bit reservoir. This perceptual entropy threshold is used to select either LONG block or SHORT block. When only an insufficient number of bits are available, frames containing an attack sound are coded not as SHORT blocks, but as LONG blocks to prevent the resulting sound from quality degradation.

This conventional technique, however, simply switches the choice from SHORT block to LONG block in a starving condition where the sound quality would be worse than the case of pre-echoes. LONG block coding in this case eventually develops pre-echoes and consequent quality degradation. The foregoing technique is not an optimal solution for the problem of sound quality degradation.

SUMMARY OF THE INVENTION

In view of the foregoing, it is an object of the present invention to provide an audio coding device that optimizes the block length for encoding purposes, so as to alleviate the problem of quality degradation due to pre-echoes and bit starvation.

It is another object of the present invention to provide an audio coding method that optimizes the block length for encoding purposes, so as to alleviate the problem of quality degradation due to pre-echoes and bit starvation.

To accomplish the above objects, the present invention provides an apparatus for encoding an audio signal, comprising: an acoustic analyzer that analyzes the audio signal to calculate perceptual entropy indicating how many bits are required for quantization; a coded bit count monitor that monitors the number of coded bits produced from the audio signal and calculates the number of available bits for a current frame; a frame division number determiner that determines a division number N for dividing a frame of the audio signal into N blocks, based on a combination of the perceptual entropy and the number of available bits, such that the N blocks will have lengths suitable for suppressing sound quality degradation due to pre-echoes and bit starvation; an orthogonal transform processor that divides the frame by the determined division number and subjects each divided block of the audio signal to an orthogonal transform process, thereby obtaining orthogonal transform coefficients; and a quantizer that quantizes the orthogonal transform coefficients on a divided block basis.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 7A shows an input signal waveform.

FIG. 8 shows the relationship between a LONG block and SHORT blocks.

FIG. 9 shows an overview of a conventional AAC encoder.

FIG. 10 shows a source input signal containing an attack sound.

FIG. 11 shows a pre-echo.

FIG. 12 shows a decoded sound whose source sound has been encoded as SHORT blocks.

FIG. 13 shows the concept of how a bit reservoir works.

DESCRIPTION OF THE PREFERRED EMBODIMENTS

Figure 1:
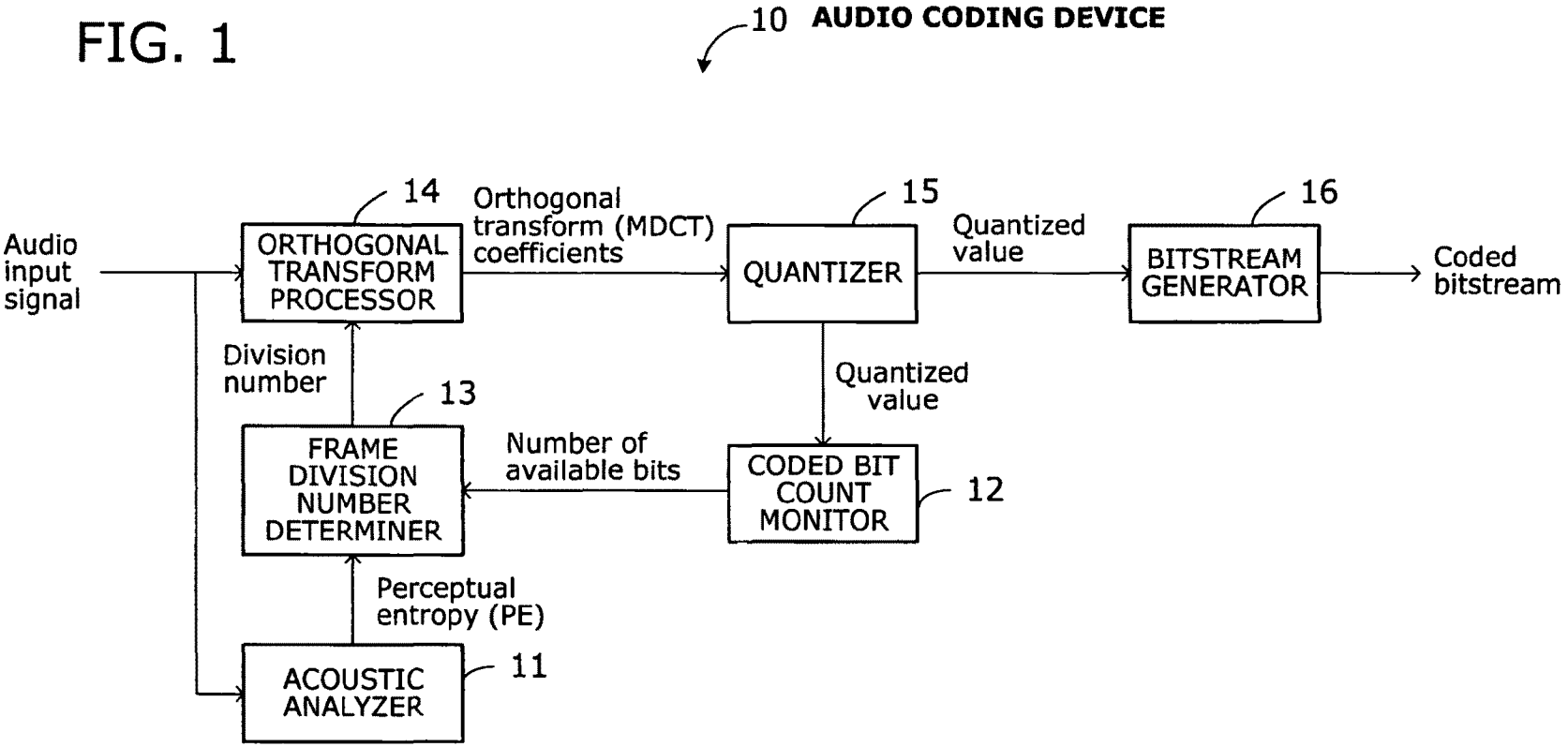
FIG. 1 is a conceptual view of an audio coding device.

Embodiments of the present invention will be described below with reference to the accompanying drawings. FIG. 1 is a conceptual view of an audio coding device according to a first embodiment of the invention. To encode audio signals, this audio coding device 10 has an acoustic analyzer 11, a coded bit count monitor 12, a frame division number determiner 13, an orthogonal transform processor 14, a quantizer 15, and a bitstream generator 16.

The acoustic analyzer 11 analyzes an audio input signal by using the Fast Fourier Transform (FFT) algorithm. From the resulting FFT spectrum, the acoustic analyzer 11 determines an acoustic parameter called perceptual entropy (PE).

The term "perceptual entropy" PE refers to a parameter indicating how many bits are required for quantization. In other words, this parameter indicates the total number of bits required to quantize a frame without introducing a noise that is perceptible to the listener.

As described earlier, the perceptual entropy PE takes a large value in a sound including an attack or a sudden increase in the signal level. While the actual audio coding process also calculates other acoustic parameters such as masking threshold, this patent specification will not describe those parameters since they are not directly related to the present invention.

The coded bit count monitor 12 calculates the balance of coded bits (i.e., determines how many bits are consumed) with respect to a predefined average number of quantized bits (described earlier in FIG. 13) each time a new frame is quantized. The coded bit count monitor 12 thus determines the number of available bits, or the number of bits available for the current frame.

Based on the combination of the perceptual entropy PE and the number of available bits, the frame division number determiner 13 determines a division number N for dividing a frame of the audio signal into N blocks, so as to select a coding block length suitable for suppressing pre-echoes and/or bit starvation and consequent degradation of sound quality.

More specifically, LONG block is selected in the case of N=1, and SHORT block is selected in the case of N=8. The audio coding device 10 divides a frame, not only into eight SHORT blocks or one LONG block, but into any number (N) of blocks with variable lengths.

The orthogonal transform processor 14 divides a frame by the determined division number and subjects each divided block of the audio signal to an orthogonal transform process, thereby obtaining orthogonal transform coefficients (frequency spectrum). The term "orthogonal transform" refers to, for example, the Modified Discrete Cosine Transform (MDCT). The resulting coefficients are thus referred to as MDCT coefficients.

To be more specific about operation, the orthogonal transform processor 14 transforms frames as LONG blocks or SHORT blocks. In the case of LONG block, the orthogonal transform processor 14 calculates MDCT coefficients at 1024 points. In the case of SHORT block, the orthogonal transform processor 14 calculates MDCT coefficients at 128 points for each block. Since one frame consists of eight SHORT blocks, the transform process yields eight sets of MDCT coefficients in the case of SHORT block. Those MDCT coefficients (frequency spectrums) are then supplied to the subsequent quantizer 15.

The quantizer 15 quantizes the MDCT coefficients calculated on a divided block basis. To optimize this quantization process, the quantizer 15 controls consumption of bits, such that the total number of final output bits will not exceed the number of bits that the quantizer 15 is allowed to use in the current block. The quantizer 15 supplies the quantized values to the bitstream generator 16. The bitstream generator 16 compiles them into a bitstream according to a format suitable for delivery over a transmission channel.

The following section will now describe how the frame division number determiner 13 determines a division number for dividing a frame of an audio signal. The frame division number determiner 13 receives a perceptual entropy PE from the acoustic analyzer 11, as well as the number of available bits from the coded bit count monitor 12. Based on those parameters, the frame division number determiner 13 determines a division number N for a frame and outputs it to the orthogonal transform processor 14.

The frame division number N is affected by the value of perceptual entropy PE and the number of available bits. Specifically, a small perceptual entropy PE indicates that most part of the frame is made up of stationary signal components. A large perceptual entropy PE, on the other hand, suggests that the frame contains a large transient variation such as an attack sound. In the latter case, selecting a long coding block length would lead to sound degradation due to pre-echoes.

Accordingly, it is necessary to choose a shorter coding block length (or a larger frame division number N) in the case where the perceptual entropy PE is large, so as to suppress pre-echoes and consequent sound quality degradation.

Regarding the number of available bits, on the other hand, a short coding block length results in consuming a larger number of bits when quantizing a frame. If there are only a small number of available bits, the sound would be degraded because of bit starvation.

Accordingly, it is necessary to choose a longer coding block length (or a smaller frame division number N) in the case where the number of available bits is small, so as to suppress bit starvation and consequent sound quality degradation.

Taking into consideration the above-described relationships between perceptual entropy PE and the number of available bits, the frame division number determiner 13 has a conversion map to determine a division number N corresponding to a particular combination of those two parameters, so as to select an appropriate coding block length for suppressing quality degradation due to pre-echoes and/or bit starvation.

Figure 2:
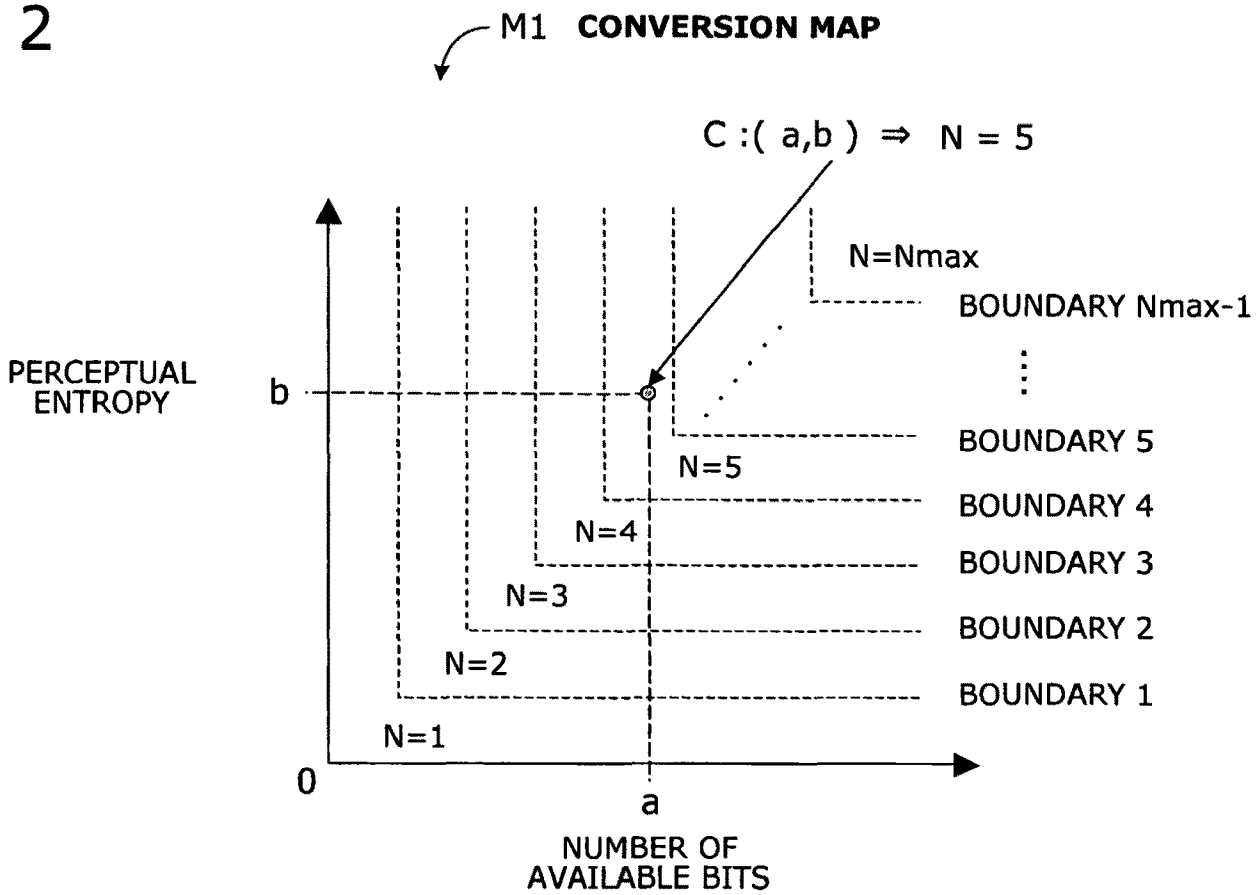
FIG. 2 shows a conversion map.

FIG. 2 shows a conversion map M1, where the vertical axis represents perceptual entropy and the horizontal axis represents the number of available bits. There are boundaries 1 to Nmax−1 for determining a division number N, where Nmax is the maximum division number for a frame.

This conversion map M1 is used to select a specific division number N corresponding to a combination C=(a, b), where 'a' is the number of available bits and 'b' is a perceptual entropy PE. Specifically, FIG. 2 shows that '5' is selected as the division number.

While the boundaries are evenly drawn in the conversion map M1 of FIG. 2, the present invention is not limited to that configuration. Alternatively, the boundaries may be placed according to the position where the input signal varies. Another alternative method is to define a division number Block_Num as a function F of Available_bit (the number of available bits) and PE (perceptual entropy), as in Block_Num=F(Available_bit, PE).

The orthogonal transform processor 14 divides the input signal frame into N blocks according to the division number N and subjects each divided block to MDCT to obtain a frequency spectrum. The quantizer 15 quantizes MDCT coefficients calculated on a divided block basis.

Figure 3:
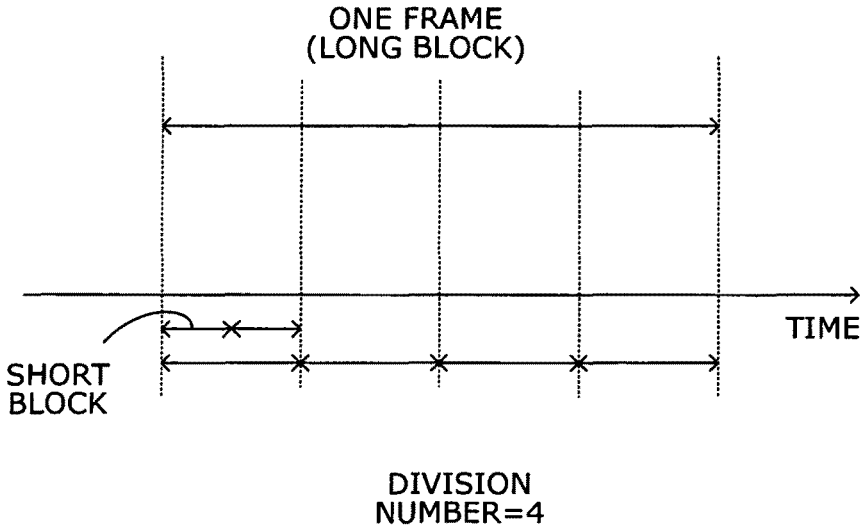
FIG. 3 shows an example of frame partitioning.

FIG. 3 shows an example of frame partitioning. Specifically, FIG. 3 assumes that the frame division number determiner 13 has selected a division number of 4. Conventionally, the MDCT and quantization processing takes place on either a LONG block or eight SHORT blocks. In contrast, the proposed audio coding device 10 divides a frame into any number of blocks, where the division number is determined according to the perceptual entropy PE and the number of available bits, so as to suppress sound quality degradation due to pre-echoes and bit starvation. Then the audio coding device 10 executes MDCT and quantization on a divided block basis.

As FIG. 3 shows, one frame consisting of 1024 samples is divided into four blocks each with a length of 256 samples. The MDCT and quantization processing takes place on each of those blocks.

As can be seen from the above explanation, the audio coding device 10 determines a division number N for dividing an audio signal frame, based on a combination of a frame's perceptual entropy PE and the number of available bits. The audio coding device 10 then divides the frame by the determined division number, calculates MDCT coefficients by performing MDCT on each divided audio signal block, and quantizes the MDCT coefficients of each divided block.

When encoding frames containing a large variation such as an attack sound, SHORT blocks may be selected to suppress pre-echoes. The use of SHORT blocks in this case, however, could consume too many bits, and the consequent bit starvation produces a harsher quality degradation than those deriving from pre-echoes. The conventional technique (e.g., Japanese Patent Application Publication No. 2005-3835) therefore selects LONG block when encoding such frames.

That is, the conventional technique has only two options for block length selection, either SHORT block (dividing one frame into eight blocks) or LONG block (no dividing). LONG block is selected to avoid quality degradation that would be caused by bit starvation in encoding a frame containing a large variation. However, the resulting sound would end up with being distorted by pre-echoes. That is, the conventional techniques are unsuccessful in effectively suppressing sound quality degradation.

By contrast, the proposed audio coding device 10 determines a division number N to select an appropriate coding block length for suppressing quality degradation due to pre-echoes and/or bit starvation, based on a combination of perceptual entropy PE and the number of available bits. The division number N can take any value, thus permitting the blocks to have any lengths, rather than restricting them to SHORT blocks or LONG blocks. Since it performs MDCT and quantization on the basis of such block lengths, the audio coding device 10 greatly alleviates sound quality degradation even when it is used under high-compression, low-bitrate conditions.

Figure 4:
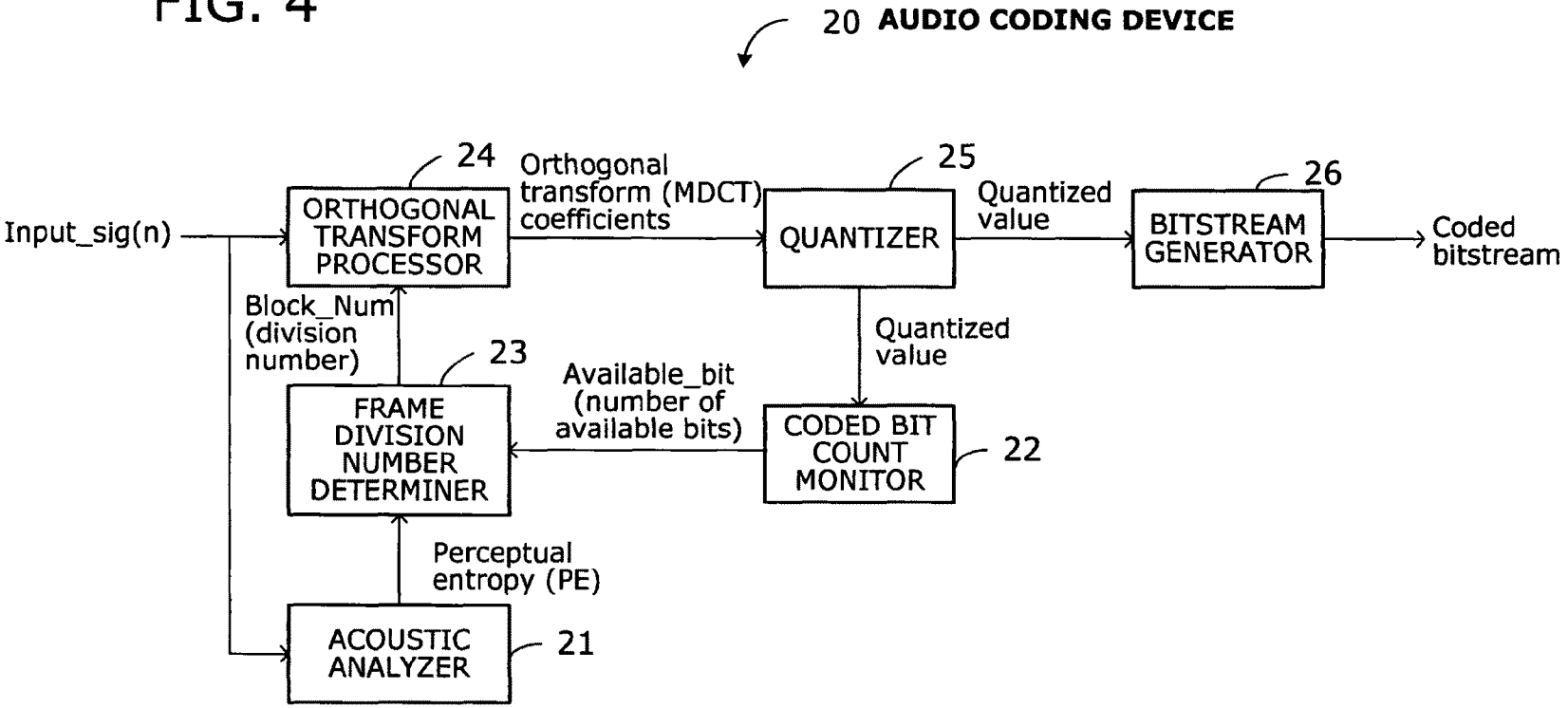
FIG. 4 is a conceptual view of an audio coding device.

The following will now describe an audio coding device according to a second embodiment of the present invention. FIG. 4 is a conceptual view of an audio coding device. To encode audio signals, this audio coding device 20 includes an acoustic analyzer 21, a coded bit count monitor 22, a frame division number determiner 23, an orthogonal transform processor 24, a quantizer 25, and a bitstream generator 26.

The acoustic analyzer 21 analyzes an audio input signal by using the FFT algorithm. From the resulting FFT spectrum, the acoustic analyzer 21 determines an acoustic parameter called perceptual entropy (PE).

The coded bit count monitor 22 calculates the balance of coded bits (i.e., determines how many bits are consumed) with respect to a predefined average number of quantized bits after quantization of each frame. The coded bit count monitor 22 then calculates the number of available bits (Available_bit), or the number of bits available for the current frame.

Based on the combination of the perceptual entropy PE and the number of available bits, the frame division number determiner 23 determines a division number N for dividing a frame of the audio signal, so as to select a coding block length suitable for suppressing pre-echoes and/or bit starvation and consequent degradation of sound quality.

The following section assumes that the audio coding device 20 operates as an AAC encoder with a maximum division number of eight (i.e., minimum-sized blocks=SHORT blocks). The determined division number (Block_Num) is supplied to the orthogonal transform processor 24.

In the case where the division number N equals one, the orthogonal transform processor 24 calculates first orthogonal transform coefficients by performing an orthogonal transform (MDCT) on an entire frame basis. In the case where N=Nmax, or the maximum division number, the orthogonal transform processor 24 divides a frame by the maximum division number and calculates second orthogonal transform coefficients by performing an orthogonal transform on each divided block of the audio signal. In the case of 1<N<Nmax, the orthogonal transform processor 24 calculates second orthogonal transform coefficients for a frame divided by the maximum division number and combines the resultant coefficients into as many groups as the division number N.

In the case of N=1, the quantizer 25 quantizes the first orthogonal transform coefficients on an entire frame basis. In the case of N=Nmax, the quantizer 25 quantizes the second orthogonal transform coefficients on a divided block basis. Further, in the case of 1<N<Nmax, the quantizer 25 quantizes the second orthogonal transform coefficients on an individual group basis.

The following will give more details about how the audio coding device 20 operates. Suppose now that a frame of an input signal is supplied to the orthogonal transform processor 24 and acoustic analyzer 21 shown in FIG. 4. This frame consists of 1024 samples, Input_sig(n) (n=0 . . . 1023).

[Acoustic Analyzer 21]

The acoustic analyzer 21 calculates perceptual entropy PE according to the characteristics of human hearing system and supplies it to the frame division number determiner 23.

[Coded Bit Count Monitor 22]

The coded bit count monitor 22 calculates Available_bit, the number of available bits, of the current frame and supplies it to the frame division number determiner 23. The following formula (1) gives Available_bit:

$$\text{Available_bit}=\text{average_bit}+\text{Reserve_bit} \quad (1)$$

where "average_bit" represents the average number of quantized bits that is previously determined for encoding, and "Reserve_bit" represents the number of bits being accumulated in the bit reservoir. Specifically, Reserve_bit is calculated as:

$$\text{Reserve_bit}=\text{Prev_Reserve_bit}+(\text{average_bit}-\text{quant_bit}) \quad (2)$$

where "quant_bit" represents the number of coded (quantized) bits of the preceding frame, and "Prev_Reserve_bit" represents Reserve_bit of the preceding frame. Reserve_bit is expressed as the balance of the number of quantized bits of the current frame with respect to the average number of bits.

The parameter average_bit is calculated by the following formula (3):

$$\text{average_bit}=(\text{bitrate}\times\text{frame_length})/\text{freq} \quad (3)$$

where "bitrate" represents a coding bit rate in units of bps, "frame_length" represents the length of a frame (e.g., 1024 samples), and "freq" represents a sampling frequency for input signals in units of Hz.

[Frame Division Number Determiner 23]

The frame division number determiner 23 determines a division number N (Block_Num) according to the perceptual entropy PE calculated by the acoustic analyzer 21 and Available_bit calculated by the coded bit count monitor 22. The frame division number determiner 23 supplies the determined division number to the orthogonal transform processor 24.

The division number is determined by using the conversion map M1 described earlier in FIG. 2. Specifically, the conversion map M1 previously defines boundaries 1 to 7 (although the number of boundaries and their distances can be selected as necessary), so that a division number N can be determined from the coordinate position C=(Available_bit,PE) representing a combination of a specific perceptual entropy PE and the number of available bits Available_bit.

[Orthogonal Transform Processor 24]

In the case of Block_Num=1, the orthogonal transform processor 24 performs MDCT on 1024 input signal samples as a LONG block, thereby obtaining MDCT coefficients (MDCT_LONG). This MDCT_LONG is what has been mentioned as the first orthogonal transform coefficients.

In the case of Block_Num=8 (Nmax=8), the orthogonal transform processor 24 performs MDCT on each 128 input signal samples constituting a SHORT block, thereby obtaining eight sets of MDCT coefficients (MDCT_SHORT). This MDCT_SHORT is what has been mentioned as the second orthogonal transform coefficients.

In the case of 1<Block_Num<8, the orthogonal transform processor 24 first calculates MDCT_SHORT. That is, the orthogonal transform processor 24 performs MDCT on each 128 input signal samples constituting a SHORT block, thereby obtaining eight sets of MDCT coefficients (MDCT_SHORT), just as in the case of Block_Num=8.

The orthogonal transform processor 24 then combines those eight sets of MDCT coefficients into groups according to a predetermined pattern, thereby producing Block_Num sets of MDCT coefficients. In the case of Block_Num=5, for example, the eight sets of MDCT coefficients are merged into five sets.

Figure 5:
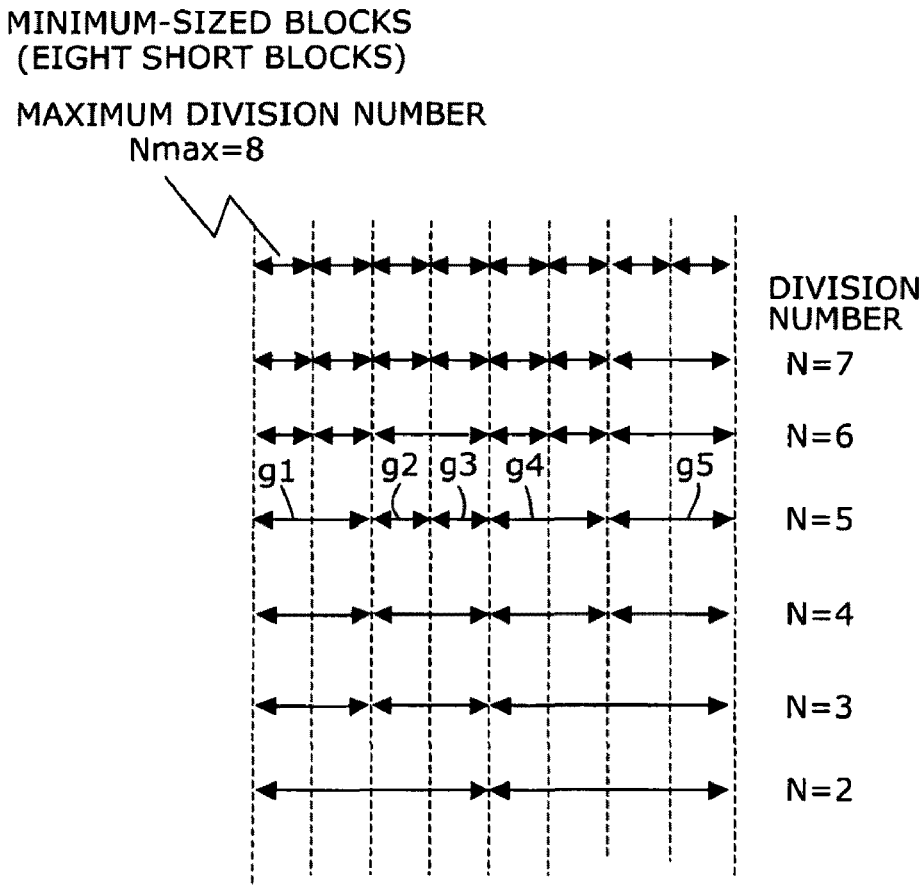
FIG. 5 shows an example of a grouping operation.

FIG. 5 shows an example of a grouping operation. Specifically, one frame is divided into eight SHORT blocks, and those minimum-sized blocks are grouped in accordance with the division numbers 2 to 7.

When the division number is 5, the blocks are combined into five groups g1 to g5 as shown in FIG. 5. MDCT coefficients of each group are supplied to the subsequent quantizer 25 for group-based quantization. Specifically, the quantizer 25 first quantizes MDCT coefficients of group g1 and then proceeds to quantization of MDCT coefficients of group g2.

Figure 6:
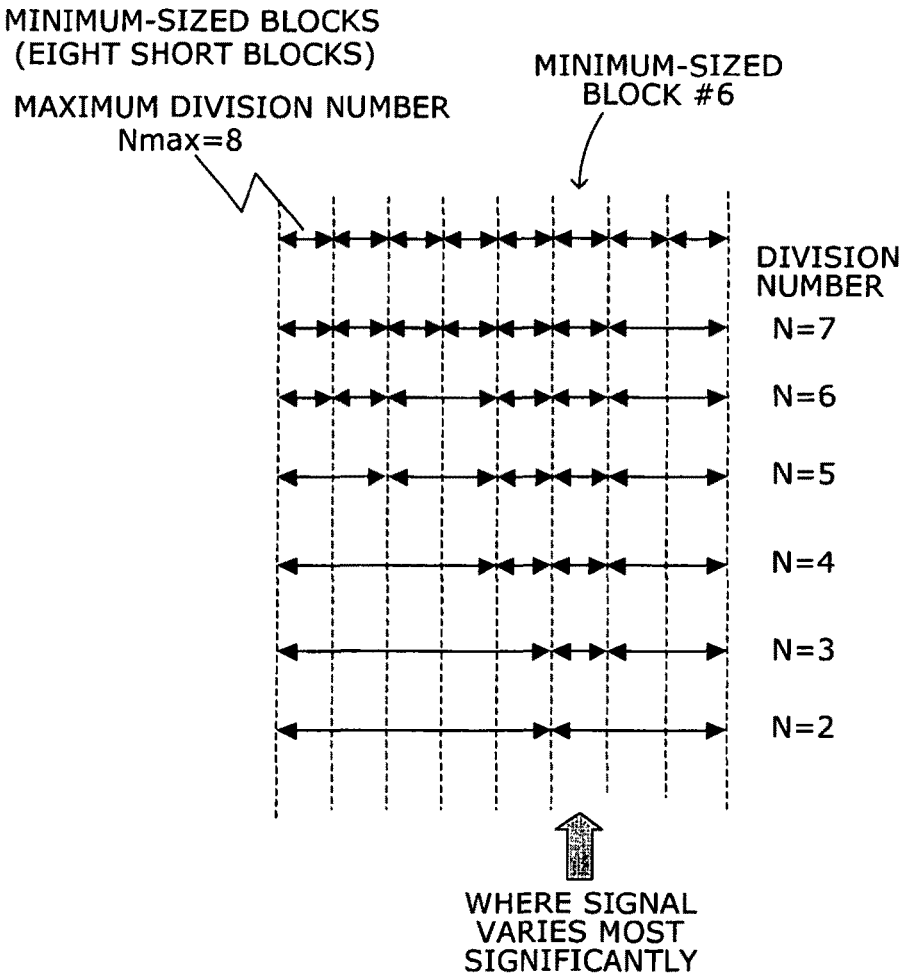
FIG. 6 shows another example of a grouping operation.

FIG. 6 shows another example of a grouping operation. The boundaries between groups can be set in the illustrated way, such that the blocks containing or near the point where the signal varies will be as small as possible.

It is assumed in FIG. 6 that a large variation such as an attack sound occurs in minimum-sized block #6 or thereabout. In this case, the groups are defined in such a way that the block #6 and its neighboring blocks will be as small as possible. Pre-echoes can be reduced more effectively by defining group boundaries in such a way that the blocks containing or near the point where the signal varies will be as small as possible.

[Quantizer 25]

In the case of Block_Num=1, the quantizer 25 quantizes MDCT coefficients MDCT_LONG. That is, the quantizer 25 outputs quantized values of MDCT coefficients representing the entire frame.

In the case of Block_Num=8, the quantizer 25 quantizes MDCT coefficients MDCT_SHORT. That is, the quantizer 25 outputs quantized valued of eight (the maximum division number) sets of MDCT coefficients.

In the case of 1<Block_Num<8, the quantizer 25 quantizes MDCT coefficients MDCT_SHORT for each group of SHORT blocks and outputs the resulting quantized values.

In either of the above cases, the quantizer 25 quantizes MDCT coefficients in each frequency band. More specifically, the quantizer 25 quantizes 1024 MDCT coefficients on an individual frequency band basis when coding a LONG block. When coding a SHORT block, the quantizer 25 quantizes 128 MDCT coefficients on an individual frequency band basis. When coding a two-block group, as in group g1 shown in FIG. 5, the quantizer 25 quantizes of 256 (=128×2) MDCT coefficients on an individual frequency band basis.

During this process, the quantizer 25 pursues optimal quantization by controlling quantization errors with respect to the number of bits, such that the total number of bits produced as the final outcome will fall below the number of bits that the current block is allowed to consume.

The quantizer 25 then outputs the quantized spectrum values to the bitstream generator 26.

[Bitstream Generator 26]

The bitstream generator 26 produces a bitstream from the quantized values obtained by the quantizer 25 by compiling them in a format for transmission and sends out the bitstream to the transmission channel.

Figure 7A:
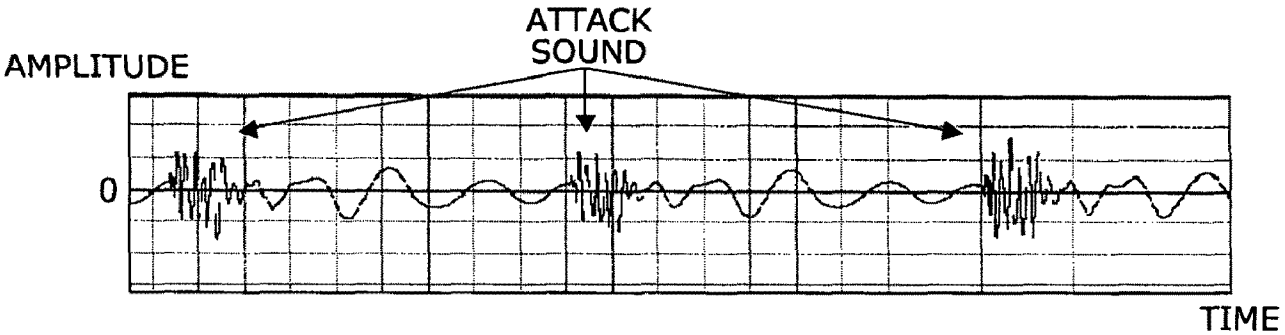
FIGS. 7A, B and C show waveforms of coded speech signals. Specifically.
Figure 7B:
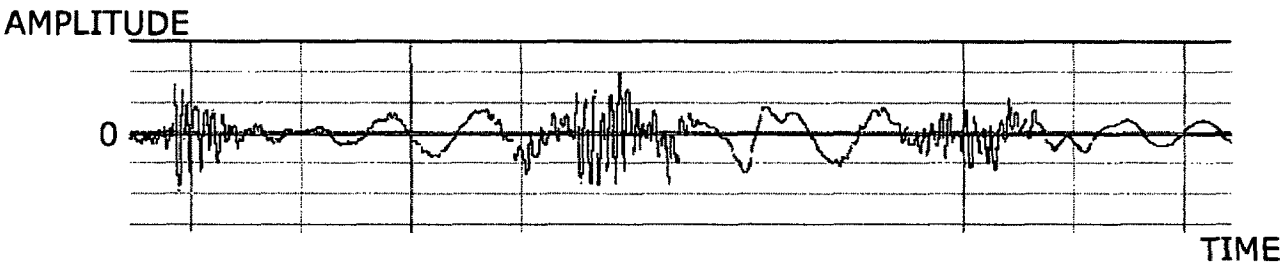
FIG. 7B shows a waveform of a signal encoded as SHORT blocks in a condition of bit starvation.
Figure 7C:
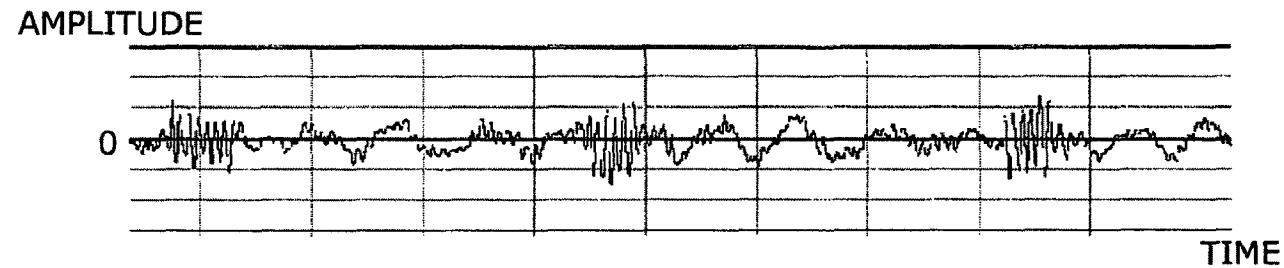
FIG. 7C shows a waveform of a signal encoded in accordance with the present invention.

The following section will describe the advantages of the audio coding device 20. FIGS. 7A, B and C show some actually measured waveforms of coded speech signals. Specifically, FIG. 7A shows an input signal waveform, FIG. 7B shows a waveform of a signal encoded as SHORT blocks in a condition of bit starvation, and FIG. 7C shows a waveform of a signal encoded in accordance with the present invention.

The input signal shown in FIG. 7A contains some attack sounds. If such an input signal is encoded as SHORT blocks in spite of bit starvation, the resulting signal will be heavily distorted in the attack sound portions as shown in FIG. 7B. That is, the signal suffers a significant quality degradation.

In contrast, the present invention permits the signal to be encoded as divided blocks with optimal lengths. The result is a better waveform in the attack sound portions as shown in FIG. 7C. While some amount of pre-echoes are observed as minute artifacts in the portion surrounding each attack sound, such pre-echo noise is too small to be perceived by a human ear.

In the way described above, the present invention suppresses degradation of sound quality which is caused by both pre-echoes and bit starvation. Thus the present invention greatly alleviates quality degradation that the listener may perceive.

The following section will now describe in what field the audio coding devices 10 and 20 can be used. Specifically, the audio coding devices 10 and 20 can be applied to, for example, a one-segment digital radio broadcasting system and a music downloading service system.

The one-segment broadcasting services require higher data compression ratios since their transmission bandwidth is narrower (lower transmission rate) than those of conventional digital terrestrial television broadcasting services. This means that the mobile applications need more efficient data compression techniques. In addition, mobile terminals employ a redundant data transmission mechanism to fight against errors (data loss) when transmitting coded data over a radio communications channel. An even higher compression ratio is thus required to compensate for the redundancy of transmitted data.

Music download services for mobile equipment, on the other hand, require not only high quality sound, but also high data compression ratios. One reason for this is that the mobile users may not always have a sufficient amount of memory space in their mobile devices. Another reason is that some mobile users have concerns about how much they are charged for transmission of data.

The audio coding devices 10 and 20 are designed to encode a frame after dividing it into blocks with optimal lengths according to the frames perceptual entropy PE and the number of available bits, so as to suppress sound quality degradation caused by pre-echoes and bit starvation. The audio coding devices 10 and 20 significantly improve the sound quality in the high-compression, low-bitrate conditions mentioned above.

As can be seen from the preceding discussion, the present invention determines optimal block lengths (or optimal number of divided blocks), taking the number of available bits into consideration. This is achieved by monitoring the perceptual entropy (indicating how much the input signal varies) obtained through an acoustic analysis of input signals, as well as the number of bits available at that time, to estimate possible quality degradation. This feature of the present invention avoids selection of SHORT blocks in conditions of bit starvation, thus making it possible to prevent the sound from being deteriorated too much.

The present invention is also designed to combine frequency spectrums into groups when they are obtained through an orthogonal transform of a frame divided by the maximum division number Nmax. This feature of the present invention permits a frame to be divided virtually into any number (N) of groups even in the case where choices for the division number are limited by the coding algorithms being used (for example, the AAC encoder only allows choosing the maximum division number of 8 to encode a frame as SHORT blocks).

The present invention further makes it possible to reduce pre-echoes produced at a point where the input signal varies even in the case of small division numbers. This is achieved by determining the boundaries between blocks depending on where the input signal actually varies.

According to the present invention, the audio coding device determines a division number N for dividing a frame of an audio signal into N blocks, based on a combination of perceptual entropy and the number of available bits, divides a frame into as many blocks as the division number, performs orthogonal transform on each divided block of the audio signal, and quantizes the resulting orthogonal transform coefficients on a divided block basis. The present invention enables coding of audio signals with optimal block lengths, thus alleviating sound quality degradation due to pre-echoes and bit starvation. The present invention thus contributes to quality improvement of audio signal coding.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An apparatus for encoding an audio signal, comprising:

an acoustic analyzer that analyzes the audio signal to calculate perceptual entropy indicating how many bits are required for quantization;

a coded bit count monitor that monitors the number of coded bits produced from the audio signal and calculates the number of available bits for a current frame;

a frame division number determiner that determines a division number N for dividing a frame of the audio signal into N blocks, based on a combination of the perceptual entropy and the number of available bits, such that the N blocks will have lengths suitable for suppressing sound quality degradation due to pre-echoes and bit starvation;

an orthogonal transform processor that divides the frame by the determined division number and subjects each divided block of the audio signal to an orthogonal transform process, thereby obtaining orthogonal transform coefficients; and a quantizer that quantizes the orthogonal transform coefficients on a divided block basis;

wherein:

the frame division number determiner comprises a conversion map defining the division number with respect to the perceptual entropy and the number of available bits;

the conversion map gives a larger division number for a larger perceptual entropy, so that the resulting blocks will have shorter lengths suitable for suppressing pre-echoes and consequent degradation of sound quality; and the conversion map gives a smaller division number for a smaller number of available bits, so that the resulting blocks will have longer lengths suitable for suppressing bit starvation and consequent degradation of sound quality.

2. An apparatus for encoding an audio signal, comprising:

an acoustic analyzer that analyzes the audio signal to calculate perceptual entropy indicating how many bits are required for quantization;

a coded bit count monitor that monitors the number of coded bits produced from the audio signal and calculates the number of available bits for a current frame;

a frame division number determiner that determines a division number N for dividing a frame of the audio signal into blocks, based on a combination of the perceptual entropy and the number of available bits, such that the N blocks will have lengths suitable for suppressing sound quality degradation due to pre-echoes and bit starvation;

an orthogonal transform processor calculates first orthogonal transform coefficients by performing an orthogonal transform on the entire frame in the case of N=1, calculates second orthogonal transform coefficients by dividing the frame by a maximum division number Nmax and performing an orthogonal transform on each divided block of the audio signals in the case of N=Nmax, and calculates the second orthogonal transform coefficients by dividing the frame by the maximum division number and performing an orthogonal transform thereon and combines the calculated second orthogonal transform coefficients into as many groups as the division number N in the case of 1<N<Nmax; and a quantizer that quantizes the first orthogonal transform coefficients on an entire frame basis in the case of N=1, quantizes the second orthogonal transform coefficients on a divided block basis in the case of N=Nmax, and quantizes the second orthogonal transform coefficients on an individual group basis in the case of 1<N<N max.

3. The apparatus according to claim 2, wherein:

the frame division number determiner comprises a conversion map defining the division number with respect to the perceptual entropy and the number of available bits;

the conversion map gives a larger division number for a larger perceptual entropy, so that the resulting blocks will have shorter lengths suitable for suppressing pre-echoes and consequent degradation of sound quality; and the conversion map gives a smaller division number for a smaller number of available bits, so that the resulting blocks will have longer lengths suitable for suppressing bit starvation and consequent degradation of sound quality.

4. The apparatus according to claim 2, wherein the orthogonal transform processor defines boundaries between groups in such way that a group of blocks containing or near a point where the audio signal varies will have a shorter length.

5. A method of encoding audio signals, comprising:

analyzing the audio signal to calculate perceptual entropy indicating how many bits are required for quantization;

monitoring the number of coded bits produced from the audio signal to calculate the number of available bits for a current frame;

determining a division number N for dividing a frame of the audio signal into N blocks, based on a combination of the perceptual entropy and the number of available bits, such that the N blocks will have lengths suitable for suppressing sound quality degradation due to pre-echoes and bit starvation;

dividing the frame by the determined division number and subjecting each divided block of the audio signal to an orthogonal transform process, thereby obtaining orthogonal transform coefficients;

quantizing the orthogonal transform coefficients on a divided block basis; and providing a conversion map defining the division number with respect to the perceptual entropy and the number of available bits, wherein the conversion map giving a larger division number for a larger perceptual entropy, so that the resulting blocks will have shorter lengths suitable for suppressing pre-echoes and consequent degradation of sound quality, and wherein the conversion map gives a smaller division number for a smaller number of available bits, so that the resulting blocks will have longer lengths suitable for suppressing bit starvation and consequent degradation of sound quality.

6. A method of encoding audio signals, comprising:

analyzing the audio signal to calculate perceptual entropy indicating how many bits are required for quantization;

monitoring the number of coded bits produced from the audio signal to calculate the number of available bits for a current frame;

determining a division number N for dividing a frame of the audio signal into blocks, based on a combination of the perceptual entropy and the number of available bits, such that the N blocks will have lengths suitable for suppressing sound quality degradation due to pre-echoes and bit starvation;

in the case of N=1, calculating first orthogonal transform coefficients by performing an orthogonal transform on the entire frame;

in the case of N being equal to a maximum division number Nmax, calculating second orthogonal transform coefficients by dividing the frame by the maximum division number and performing an orthogonal transform on each divided block of the audio signals;

in the case of 1<N<Nmax, calculating the second orthogonal transform coefficients by dividing the frame by the maximum division number and performing an orthogonal transform thereon and combines the calculated second orthogonal transform coefficients into as many groups as the division number N;

in the case of N=1, quantizing the first orthogonal transform coefficients on an entire frame basis;

in the case of N=Nmax, quantizing the second orthogonal transform coefficients on a divided block basis;

in the case of 1<N<Nmax, quantizing the second orthogonal transform coefficients on an individual group basis.

7. The method according to claim 6, further comprising providing a conversion map defining the division number with respect to the perceptual entropy and the number of available bits, wherein the conversion map giving a larger division number for a larger perceptual entropy, so that the resulting blocks will have shorter lengths suitable for suppressing pre-echoes and consequent degradation of sound quality, and wherein the conversion map gives a smaller division number for a smaller number of available bits, so that the resulting blocks will have longer lengths suitable for suppressing bit starvation and consequent degradation of sound quality.

8. The method according to claim 6, wherein further comprising defining boundaries between groups in such way that a group of blocks containing or near a point where the audio signal varies will have a shorter length.

* * * * *